US006318821B1

(12) United States Patent
Martin et al.

(10) Patent No.: US 6,318,821 B1
(45) Date of Patent: Nov. 20, 2001

(54) BATHROOM TISSUE ROLL DISPENSER APPARATUS

(76) Inventors: Kenneth D. Martin; Stephen Soos, both of 2225 White Ash Ct., Florissant, MO (US) 63031

( * ) Notice: Subject to any disclaimer, the term of this patent is extended or adjusted under 35 U.S.C. 154(b) by 0 days.

(21) Appl. No.: 09/490,998

(22) Filed: Jan. 25, 2000

Related U.S. Application Data

(60) Provisional application No. 60/117,596, filed on Jan. 27, 1999.

(51) Int. Cl.[7] ..... B65H 23/16

(52) U.S. Cl. ..... 312/34.8; 221/226; 242/559.3; 242/559.4

(58) Field of Search ..... 312/35, 45, 42, 312/71, 72, 34.1, 34.22, 34.8, 319.1; 221/226, 233, 274; 242/559.3, 559.4, 560.1, 599.1

(56) References Cited

U.S. PATENT DOCUMENTS 2,705,576 * 4/1955 Amelio et al. ..... 221/226 X
4,058,354 11/1977 Powaska .
4,098,469 7/1978 McCarthy .
4,124,259 11/1978 Harris .
4,192,561 3/1980 Gunn .
5,570,938 11/1996 Butler .

* cited by examiner

*Primary Examiner*—Peter M. Cuomo
*Assistant Examiner*—Michael J. Fisher

(57) ABSTRACT

A tissue roll dispenser apparatus is provided for attachment to a tissue roll holder which includes a first spindle end receiver and a second spindle end receiver. The tissue roll dispenser apparatus includes a plurality of tissue rolls to be used in succession. The tissue roll dispenser apparatus includes a first support plug assembly for engagement with the first spindle end receiver and for receiving a first spindle end of a roll spindle. A second support plug assembly engages with the second spindle end receiver and receives a second spindle end of the roll spindle. A first housing extension is connected to the first support plug assembly, and a second housing extension is connected to the second support plug assembly. A tissue roll retention housing, which includes a first housing wall, is connected to the first housing extension. A second housing wall is connected to the second housing extension, and a housing floor extends between the first housing wall and the second housing wall. An uplift spring assembly is retained in the tissue roll retention housing. Stop members are connected to the first and second housing walls. Each of the first support plug assembly and the second support plug assembly includes a plug member reception groove in a respective housing extension.

3 Claims, 3 Drawing Sheets

BATHROOM TISSUE ROLL DISPENSER APPARATUS

CROSS-REFERENCE TO RELATED APPLICATION

This application claims priority based upon my Provisional Application Ser. No. 60/117,596, filed Jan. 27, 1999.

BACKGROUND OF THE INVENTION

1. Field of the Invention

The present invention relates generally to devices for storing rolls of toilet paper, and, more particularly, to toilet paper roll storage devices which permit a roll of toilet paper to be used while other rolls are retained in storage.

2. Description of the Prior Art

Toilet paper is a consumable material, and it may run out at a very inappropriate time. In this respect, throughout the years, a number of innovations have been developed relating to retaining additional rolls of toilet paper in the event that a roll that is being used runs out. The following U.S. Pat. Nos. are representative of some of those innovations: 4,058,354, 4,098,469, 4,124,259, 4,192,561, and 5,570,938.

More specifically, each of U.S. Pat. Nos. 4,058,354, 4,192,561, and 5,570,938 discloses a device for storing rolls of toilet paper. However, none of these devices permits one roll of toilet paper to be used while additional rolls are held in storage. As a consequence, a roll of toilet paper that is being used must be retained in a different location from the storage device. However, for purposes of simplicity and economy, it would be desirable if a storage device for rolls of toilet paper permitted one roll of toilet paper to be used while additional rolls of toilet paper are held in storage.

Each of U.S. Pat. Nos. 4,098,469 and 4,124,259 discloses a toilet paper storage device that permits one roll of toilet paper to be used while additional rolls are retained in storage. Conventionally, a roll of toilet paper is supported by a tissue roll holder which is supported by a wall structure. It is noted, however, that neither of these storage devices is associated with a conventional tissue roll holder. For purposes of simplicity and convenience, it would be desirable if a device for storing rolls of toilet paper were associated with a conventional tissue roll holder.

Still other features would be desirable in a bathroom tissue roll dispenser apparatus. For example, when a roll of toilet paper has been used up, it would be desirable if the used up roll can be easily and conveniently replaced. In addition, when a replacement roll is to be placed in the conventional tissue roll holder, it would be desirable if the replacement roll were guided into its replacement position. Furthermore, when a toilet paper roll is in use, it is important that replacement toilet paper rolls are prevented from interfering with the in-use toilet paper roll.

Thus, while the foregoing body of prior art indicates it to be well known to use storage devices for replacement rolls of toilet paper, the prior art described above does not teach or suggest a bathroom tissue roll dispenser apparatus which has the following combination of desirable features: (1) provides a storage device for rolls of toilet paper that permits one roll of toilet paper to be used while additional rolls of toilet paper are held in storage; (2) is associated with a conventional tissue roll holder; (3) provides that a used up roll can be easily and conveniently replaced; (4) provides that a replacement roll is guided into its replacement position; and (5) prevents replacement toilet paper rolls from interfering with the in-use toilet paper roll. The foregoing desired characteristics are provided by the unique bathroom tissue roll dispenser apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a tissue roll dispenser apparatus for attachment to a tissue roll holder which includes a first spindle end receiver and a second spindle end receiver. The tissue roll dispenser apparatus includes a plurality of tissue rolls to be used in succession. The tissue roll dispenser apparatus includes a first support plug assembly for engagement with the first spindle end receiver and for receiving a first spindle end of a roll spindle. A second support plug assembly engages with the second spindle end receiver and receives a second spindle end of the roll spindle. A first housing extension is connected to the first support plug assembly, and a second housing extension is connected to the second support plug assembly. A tissue roll retention housing which includes a first housing wall is connected to the first housing extension. A second housing wall is connected to the second housing extension, and a housing floor extends between the first housing wall and the second housing wall. An uplift spring assembly is retained in the tissue roll retention housing. The uplift spring assembly includes an uplift floor and uplift springs located between the uplift floor and the housing floor. Stop members are connected to the first and second housing walls.

Each of the first housing wall and the second housing wall includes a spindle end reception track extending from the uplift spring assembly to one of the first and second support plug assemblies. Each of the first support plug assembly and the second support plug assembly includes a plug member reception groove in a respective housing extension. A plug member is received in a respective plug member reception groove. A plug member bias spring is located between an interior portion of the plug member and a respective housing extension. A spindle end reception well is located in a respective housing extension, opposite to a distal end of the plug member.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved bathroom tissue roll dispenser apparatus which has all of the advantages of the prior art and none of the disadvantages.

It is another object of the present invention to provide a new and improved bathroom tissue roll dispenser apparatus which may be easily and efficiently manufactured and marketed.

It is a further object of the present invention to provide a new and improved bathroom tissue roll dispenser apparatus which is of durable and reliable construction.

An even further object of the present invention is to provide a new and improved bathroom tissue roll dispenser apparatus which is susceptible of a low cost of manufacture with regard to both materials and labor, and which accordingly is then susceptible of low prices of sale to the consuming public, thereby making such bathroom tissue roll dispenser apparatus available to the buying public.

Still yet a further object of the present invention is to provide a new and improved bathroom tissue roll dispenser apparatus which provides a storage device for rolls of toilet paper that permits one roll of toilet paper to be used while additional rolls of toilet paper are held in storage.

Still another object of the present invention is to provide a new and improved bathroom tissue roll dispenser apparatus that is associated with a conventional tissue roll holder.

Yet another object of the present invention is to provide a new and improved bathroom tissue roll dispenser apparatus which provides that a used up roll can be easily and conveniently replaced.

Even another object of the present invention is to provide a new and improved bathroom tissue roll dispenser apparatus that provides that a replacement roll is guided into its replacement position.

Still a further object of the present invention is to provide a new and improved bathroom tissue roll dispenser apparatus which prevents replacement toilet paper rolls from interfering with the in-use toilet paper roll.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

With reference to the drawings, a new and improved bathroom tissue roll dispenser apparatus embodying the principles and concepts of the present invention will be described.

Figure 1:
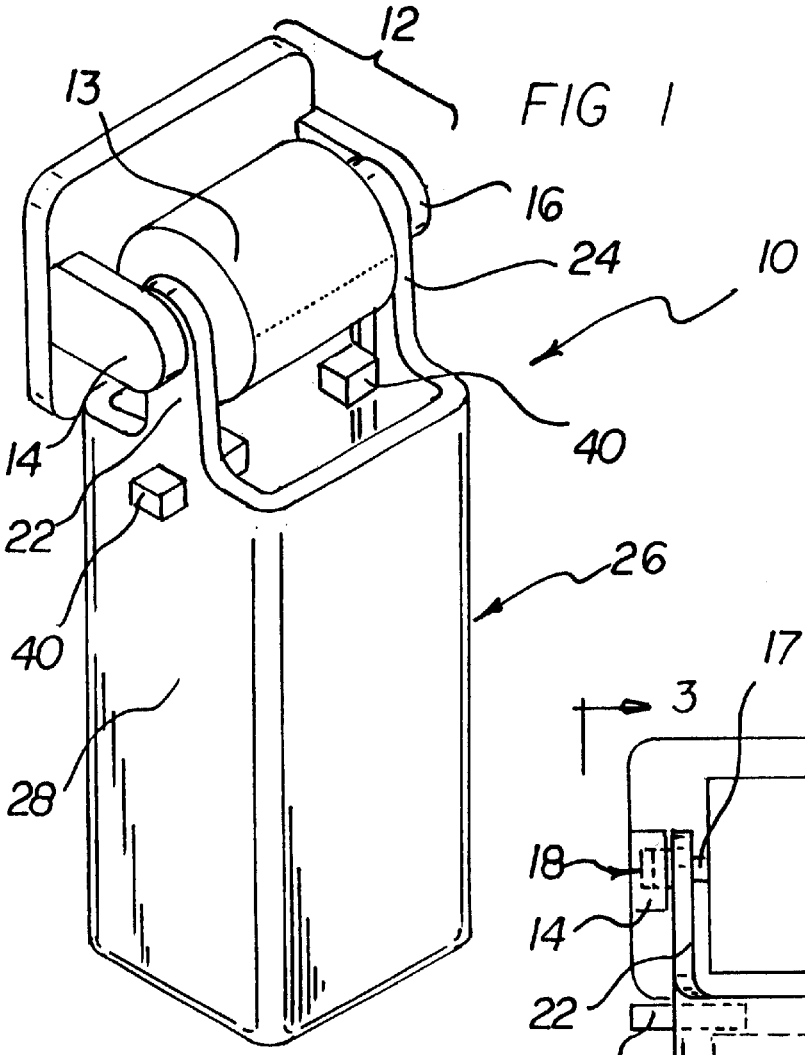
FIG. 1 is a perspective view showing a preferred embodiment of the bathroom tissue roll dispenser apparatus of the invention attached to a conventional toilet tissue roll holder.
Figure 2:
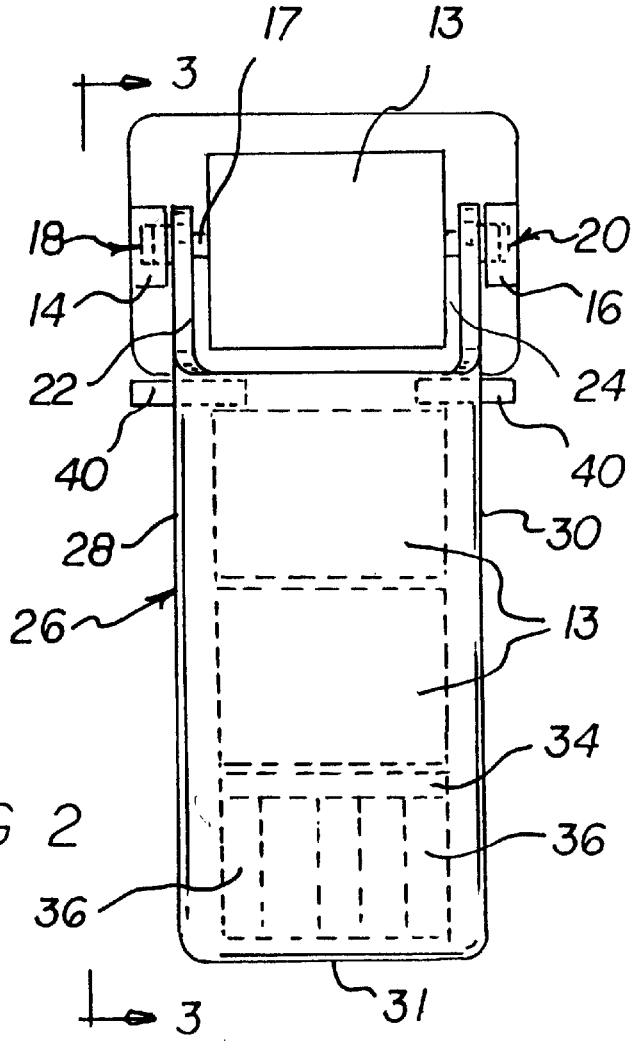
FIG. 2 is a front view of the embodiment of the bathroom tissue roll dispenser apparatus shown in FIG. 1.
Figure 3:
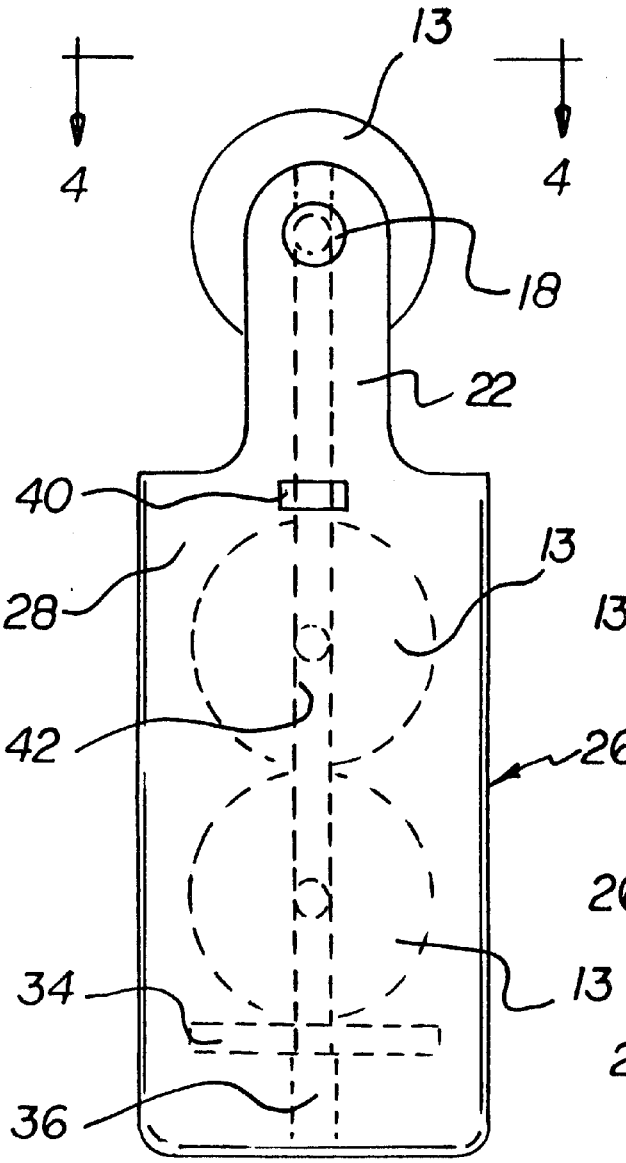
FIG. 3 is a side view of the embodiment of the bathroom tissue roll dispenser apparatus of FIG. 2 taken along line 3—3 thereof and removed from the tissue roll holder.
Figure 4:
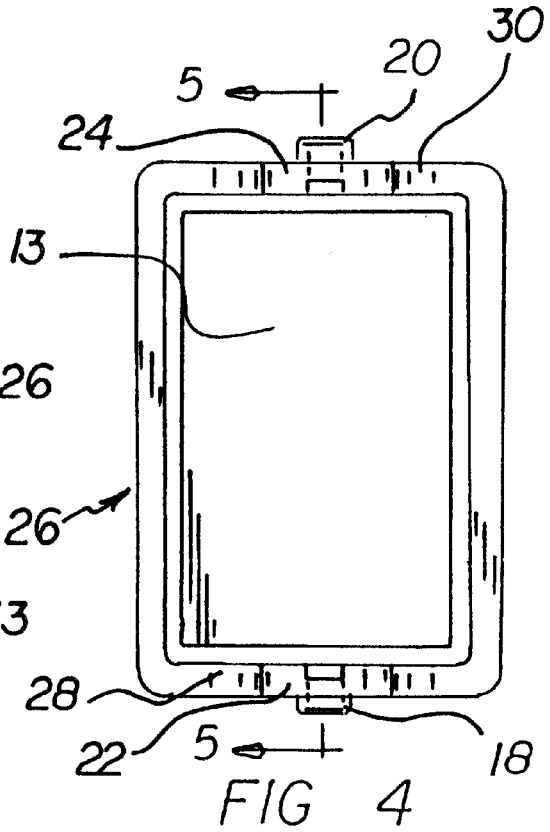
FIG. 4 is a top view of the embodiment of the bathroom tissue roll dispenser apparatus of FIG. 3 taken along line 4—4 thereof.
Figure 5:
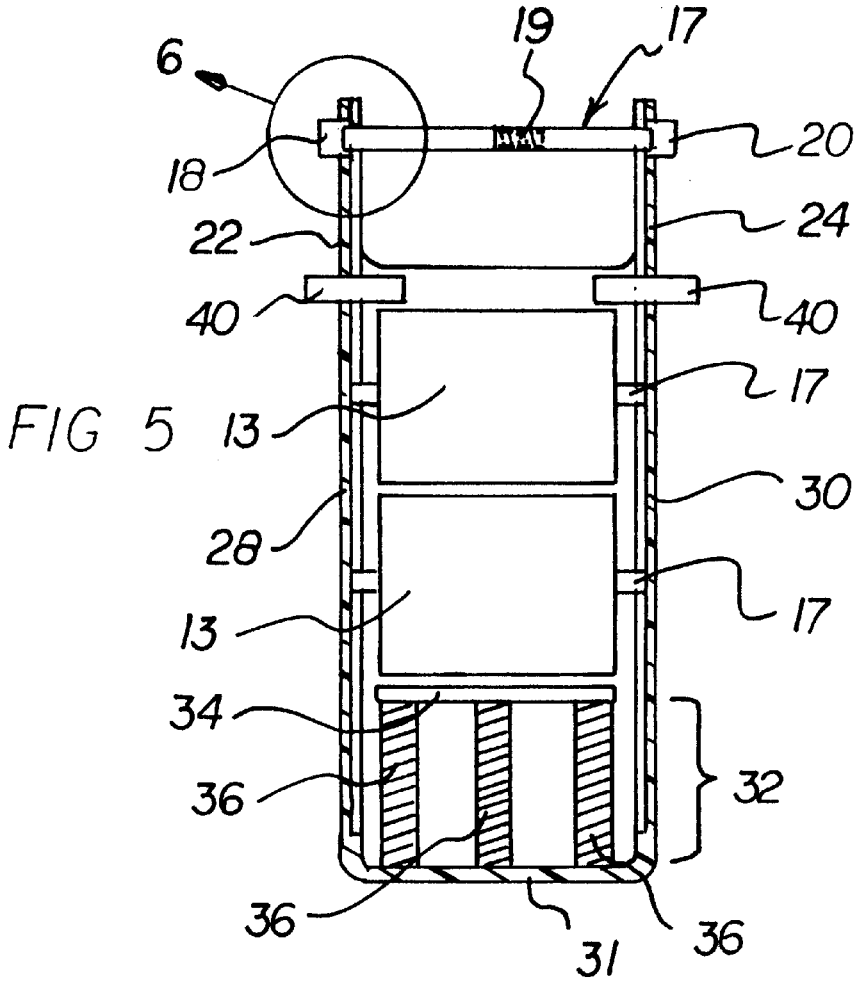
FIG. 5 is a cross-sectional view of the embodiment of the invention shown in FIG. 4 taken along line 5—5 thereof.
Figure 6:
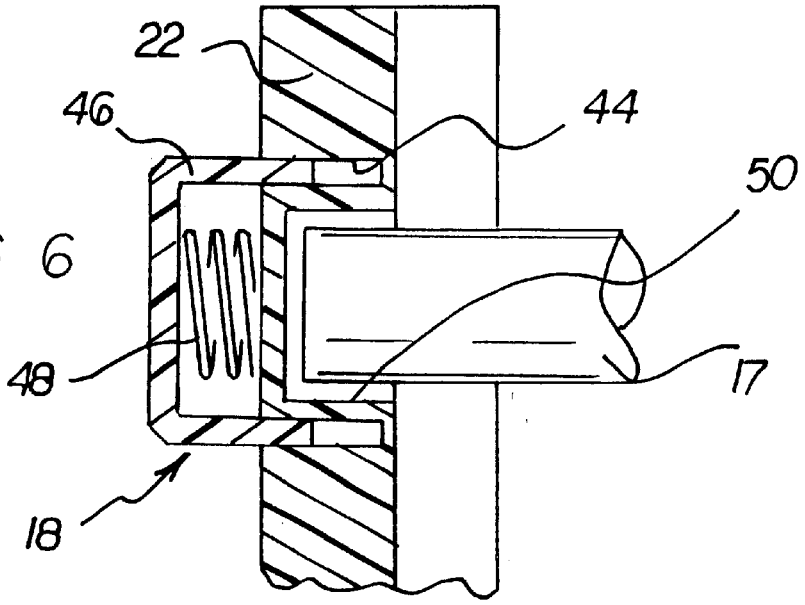
FIG. 6 is an enlarged partial cross-sectional view of the portion of the embodiment of the invention shown in the circled region 6 of FIG. 5.

Turning to FIGS. 1–6, there is shown an exemplary embodiment of the bathroom tissue roll dispenser apparatus of the invention generally designated by reference numeral 10. In its preferred form, bathroom tissue roll dispenser apparatus 10 is provided for attachment to a tissue roll holder 12 which includes a first spindle end receiver 14 and a second spindle end receiver 16. The tissue roll dispenser apparatus 10 includes a first support plug assembly 18 for engagement with the first spindle end receiver 14 and for receiving a first spindle end of a roll spindle 17. A second support plug assembly 20 engages with the second spindle end receiver 16 and receives a second spindle end of the roll spindle 17. A first housing extension 22 is connected to the first support plug assembly 18, and a second housing extension 24 is connected to the second support plug assembly 20. A tissue roll retention housing 26 which includes a first housing wall 28 is connected to the first housing extension 22. A second housing wall 30 is connected to the second housing extension 24, and a housing floor 31 extends between the first housing wall 28 and the second housing wall 30. An uplift spring assembly 32 is retained in the tissue roll retention housing 26. The uplift spring assembly 32 includes an uplift floor 34 and uplift springs 36 located between the uplift floor 34 and the housing floor 31. Stop members 40 are connected to the first and second housing walls.

Each of the first housing wall 28 and the second housing wall 30 includes a spindle end reception track 42 extending from the uplift spring assembly 32 to one of the first and second support plug assemblies. Each of the first support plug assembly 18 and the second support plug assembly 20 includes a plug member reception groove 44 in a respective housing extension. A plug member 46 is received in a respective plug member reception groove 44. A plug member bias spring 48 is located between an interior portion of the plug member 46 and a respective housing extension. A spindle end reception well 50 is located in a respective housing extension, opposite to a distal end of the plug member 46.

To use the embodiment of the invention shown in the drawings, prior to installation of the tissue roll dispenser apparatus 10 on the first spindle end receiver 14 and the second spindle end receiver 16, the stop members 40 are slid outward from the central axis of the tissue roll retention housing 26, and a plurality of tissue rolls 13 are inserted into the tissue roll retention housing 26. The tissue rolls 13 are pushed down on the uplift floor 34 to compress the uplift springs 36. Once the tissue rolls 13 have been placed in the tissue roll retention housing 26, the stop members 40 are slid inward towards the central axis of the tissue roll retention housing 26. In this way, the stop members 40 prevent the tissue rolls 13 from being uplifted by the uplift floor 34 and the uplift springs 36 past the stop members 40. When each of the tissue rolls 13 also includes a roll spindle 17, the ends of the roll spindles 17 are retained in the spindle end reception tracks 42 in the first housing wall 28 and the second housing wall 30.

Once the tissue rolls 13 have been placed in the tissue roll retention housing 26, the tissue roll dispenser apparatus 10 is then ready to be installed in the tissue roll holder 12. More specifically, the respective plug members 46 are inserted in the respective spindle end receivers 14. Then, a tissue roll 13 that includes a roll spindle 17 is brought to the tissue roll dispenser apparatus 10. More specifically, the ends of the roll spindle 17 are inserted into the respective spindle end reception wells 50. The respective plug member bias springs 48 urge the respective plug members 46 into the respective spindle end receivers, and the spindle spring 19 that is located in the roll spindle 17, urges the ends of the roll spindle 17 into the respective spindle end reception wells 50. In this way, the tissue roll dispenser apparatus 10 is supported by the tissue roll holder 12.

After the top tissue roll 13 is consumed, the roll spindle 17 is squeezed inwardly so that the ends of the roll spindle 17 are released from the spindle end reception wells 50. Then, the roll spindle 17 and the used up tissue roll 13 are removed from the apparatus. Then, the stop members 40 are moved away from the central axis of the tissue roll retention housing 26. As a result, the uplift springs 36 push upward on the uplift floor 34 to cause the topmost tissue roll 13 in the tissue roll retention housing 26 to be moved upward so that the ends of the roll spindle 17 inside the topmost tissue roll 13 engage the spindle end reception wells 50. In this way, the topmost tissue roll 13 in the tissue roll retention housing 26 becomes the tissue roll 13 that is retained by the tissue roll holder 12.

Once this tissue roll 13 is consumed, the next tissue roll 13 and its accompanying roll spindle 17 are used to replace the consumed tissue roll 13 and its accompanying roll spindle 17 in a similar way. When it is desired to replenish the supply of tissue rolls 13 in the tissue roll retention housing 26, the procedure explained above is repeated.

If desired, it is not necessary to have a separate and distinct roll spindle 17 to be associated with each tissue roll 13 that is retained in the tissue roll retention housing 26. Instead, one roll spindle 17 can be reused with each successive tissue roll 13 that is used.

The components of the bathroom tissue roll dispenser apparatus of the invention can be made from inexpensive and durable metal, plastic, and wooden materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved bathroom tissue roll dispenser apparatus that is low in cost, relatively simple in design and operation, and which may advantageously be used to provide a storage device for rolls of toilet paper that permits one roll of toilet paper to be used while additional rolls of toilet paper are held in storage. With the invention, a bathroom tissue roll dispenser apparatus is provided which is associated with a conventional tissue roll holder. With the invention, a bathroom tissue roll dispenser apparatus provides that a used up roll can be easily and conveniently replaced. With the invention, a bathroom tissue roll dispenser apparatus provides that a replacement roll is guided into its replacement position. With the invention, a bathroom tissue roll dispenser apparatus is provided which prevents replacement toilet paper rolls from interfering with the in-use toilet paper roll.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the annexed Abstract is to enable the U. S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. A tissue roll dispenser apparatus for attachment to a tissue roll holder which includes a first spindle end receiver and a second spindle end receiver, and roll spindle, comprising:

a first support plug assembly for engagement with the first spindle end receiver and for receiving a first spindle end of the roll spindle, a second support plug assembly for engagement with the second spindle end receiver and for receiving a second spindle end of the roll spindle, a first housing extension connected to said first support plug assembly, a second housing extension connected to said second support plug assembly, a tissue roll retention housing which includes a first housing wall connected to said first housing extension, a second housing wall connected to said second housing extension, and a housing floor extending between said first housing wall and said second housing wall, an uplift spring assembly retained in said tissue roll retention housing, wherein said uplift spring assembly includes an uplift floor and uplift springs located between said uplift floor and said housing floor, stop members connected to said first and second housing walls, and wherein each of said first housing wall and said second housing wall includes a spindle end reception track extending from said uplift spring assembly to one of said first and second support plug assemblies.

2. A tissue roll dispenser apparatus for attachment to a tissue roll holder which includes a first spindle end receiver and a second spindle end receiver, and roll spindle, comprising:

a first support plug assembly for engagement with the first spindle end receiver and for receiving a first spindle end of the roll spindle, a second support plug assembly for engagement with the second spindle end receiver and for receiving a second spindle end of the roll spindle, a first housing extension connected to said first support plug assembly, a second housing extension connected to said second support plug assembly, a tissue roll retention housing which includes a first housing wall connected to said first housing extension, a second housing wall connected to said second housing extension, and a housing floor extending between said first housing wall and said second housing wall, an uplift spring assembly retained in said tissue roll retention housing, wherein said uplift spring assembly includes an uplift floor and uplift springs located between said uplift floor and said housing floor, stop members connected to said first and second housing walls, and wherein each of said first support plug assembly and said second support plug assembly includes:

a plug member reception groove in a respective housing extension, a plug member received in a respective plug member reception groove, a plug member bias spring located between an interior portion of said plug member and a respective housing extension, and a spindle end reception well located in a respective housing extension, opposite to a distal end of said plug member.

3. A tissue roll dispenser apparatus for attachment to a tissue roll holder which includes a first spindle end receiver and a second spindle end receiver, and roll spindle, comprising:

a first support plug assembly for engagement with the first spindle end receiver and for receiving a first spindle end of the roll spindle, a second support plug assembly for engagement with the second spindle end receiver and for receiving a second spindle end of the roll spindle, a first housing extension connected to said first support plug assembly, a second housing extension connected to said second support plug assembly, a tissue roll retention housing which includes a first housing wall connected to said first housing extension, a second housing wall connected to said second housing extension, and a housing floor extending between said first housing wall and said second housing wall, an uplift spring assembly retained in said tissue roll retention housing, wherein said uplift spring assembly includes an uplift floor and uplift springs located between said uplift floor and said housing floor, stop members connected to said first and second housing walls, and wherein:

each of said first housing wall and said second housing wall includes a spindle end reception track extending from said uplift spring assembly to one of said first and second support plug assemblies, and each of said first support plug assembly and said second support plug assembly includes a plug member reception groove in a respective housing extension, a plug member received in a respective plug member reception groove, a plug member bias spring located between an interior portion of said plug member and a respective housing extension, and a spindle end reception well located in a respective housing extension, opposite to a distal end of said plug member.

* * * * *